US010876332B2

(12) United States Patent
Jones

(10) Patent No.: US 10,876,332 B2
(45) Date of Patent: Dec. 29, 2020

(54) SECURITY DEVICE

(71) Applicant: ERA Home Security Limited, Wolverhampton (GB)

(72) Inventor: Richard Jones, Wolverhampton (GB)

(73) Assignee: ERA Home Security Limited, Wolverhampton (GB)

( * ) Notice: Subject to any disclaimer, the term of this patent is extended or adjusted under 35 U.S.C. 154(b) by 0 days.

(21) Appl. No.: 16/291,678

(22) Filed: Mar. 4, 2019

(65) Prior Publication Data

US 2019/0330893 A1 Oct. 31, 2019

(30) Foreign Application Priority Data

Mar. 23, 2018 (GB) ..... 1804738.1

(51) Int. Cl.
*E05C 19/00* (2006.01)
*E05C 19/18* (2006.01)
*E05C 7/04* (2006.01)

(52) U.S. Cl.
CPC ..... *E05C 19/188* (2013.01); *E05C 7/04* (2013.01); *E05Y 2900/132* (2013.01); *E05Y 2900/148* (2013.01)

(58) Field of Classification Search
CPC ... B32B 2250/05; B32B 2307/51; E05C 7/04; E05C 19/188; E05Y 2900/148; E05Y 2900/132
USPC ..... 70/101; 292/288–292
See application file for complete search history.

(56) References Cited

U.S. PATENT DOCUMENTS 1,502,933 A * 7/1924 Allen ..... B60R 25/04 70/253
1,876,881 A * 9/1932 Durant ..... E05C 17/54 292/288
2,536,941 A * 1/1951 Jones ..... E05C 19/182 292/288
3,181,319 A * 5/1965 Hudon ..... E05C 19/182 70/14
3,416,333 A * 12/1968 Weingart ..... E05C 19/182 70/14
3,834,746 A * 9/1974 Hinden ..... E05C 19/182 292/290

(Continued)

FOREIGN PATENT DOCUMENTS

| | | |
|---|---|---|
| CA | 1107319 | 8/1981 |
| CA | 2084210 | 6/1994 |
| FR | 2 659 105 | 9/1990 |

OTHER PUBLICATIONS

"Run Hide Lockdown Tell" brochure published by ERA. Available at the "Security and Counter Terror Expo" held at Olympia London, on Mar. 6-7, 2018.

(Continued)

*Primary Examiner* — Suzanne L Barrett
(74) *Attorney, Agent, or Firm* — Foley & Lardner LLP

(57) ABSTRACT

A security device for a double door or double window arrangement, the device comprising a first and second barrier positioned on opposite sides of the double doors or windows. The device has a connecting portion connecting the first and second barriers. The barriers are held in position relative to the double doors or windows to prevent opening of the doors or windows, thus providing a quick way to lock down or disable a doorway or window.

29 Claims, 8 Drawing Sheets

(56) References Cited

U.S. PATENT DOCUMENTS 4,126,022 A * 11/1978 Bara Marco ..... E05B 65/0025 292/288
4,169,619 A * 10/1979 McCracken ..... E05C 19/182 292/290
4,228,842 A 10/1980 Clark
4,326,394 A * 4/1982 Stein ..... E05C 19/182 292/292
4,399,672 A * 8/1983 Moorhouse ..... E05C 19/18 292/289
5,325,685 A * 7/1994 Frank ..... E05C 19/182 292/292
5,623,841 A * 4/1997 Deemar ..... E05C 19/182 292/262
5,819,561 A * 10/1998 Blehi, III ..... E05B 67/36 70/14
5,984,387 A * 11/1999 Zeller ..... E05C 19/182 292/288
6,755,450 B1 * 6/2004 Chen ..... E05C 19/182 292/289
9,856,682 B1 * 1/2018 Cook ..... E05C 17/54
2013/0270843 A1 * 10/2013 Ploskunak ..... E05C 19/184 292/288
2014/0312634 A1 * 10/2014 Cushwa, Jr. ..... E06B 5/10 292/340
2019/0330893 A1 * 10/2019 Jones ..... E05C 19/188

OTHER PUBLICATIONS

"The Threat is Hard to Ignore," Lockdown Emergency Barricade Device, ERA Home Security, no date given, downloaded from https://www.erahomesecurity.com/mechanical-security/lockdown-door-barricade/ on May 31, 2019, 4 pages.

United Kingdom Search Report issued by the United Kingdom Intellectual Property Office for GB1804738.1, dated Sep. 25, 2018, 6 pages.

United Kingdom Search Report issued for GB1903968.4, dated Aug. 28, 2019, 6 pages.

* cited by examiner

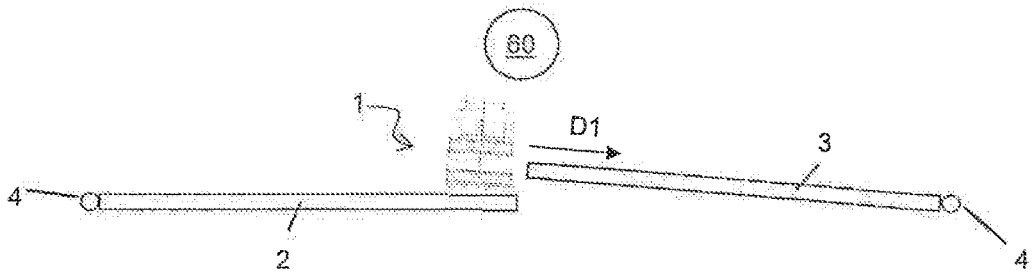
Figure 6A
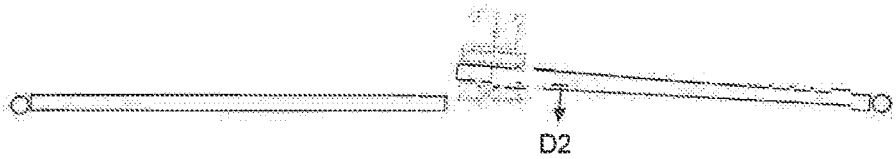
Figure 6B
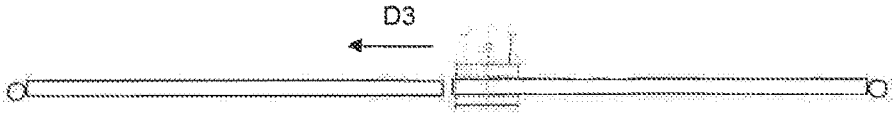
Figure 6C
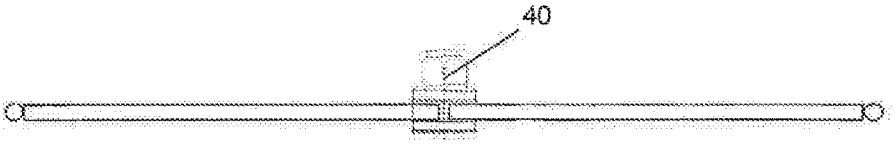
Figure 6D
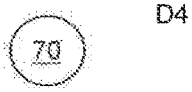

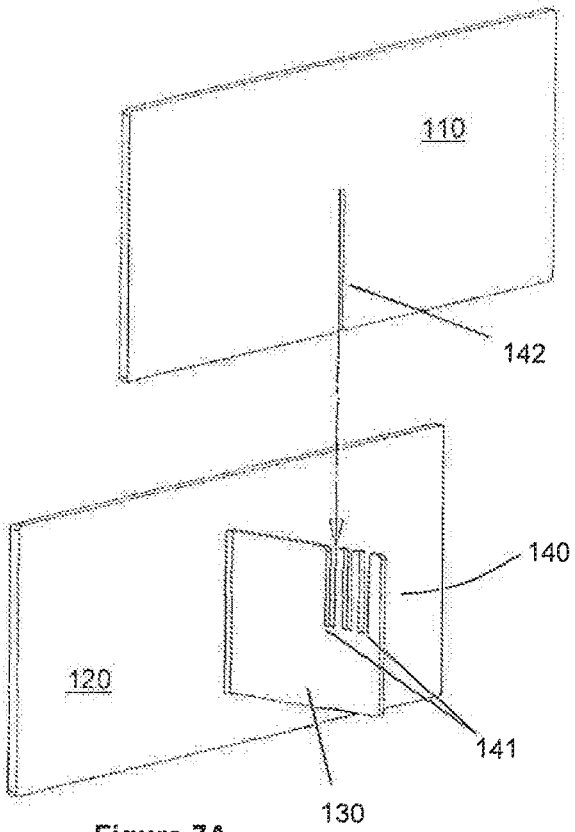
Figure 7A
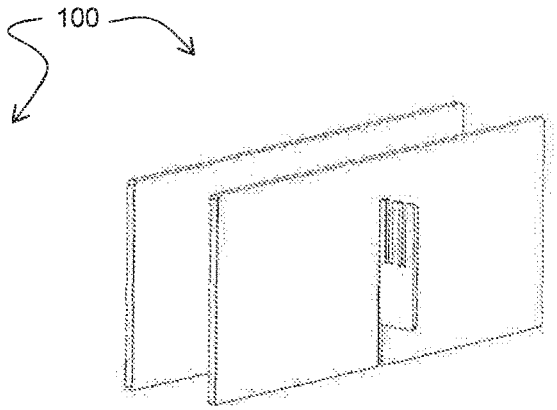
Figure 7B
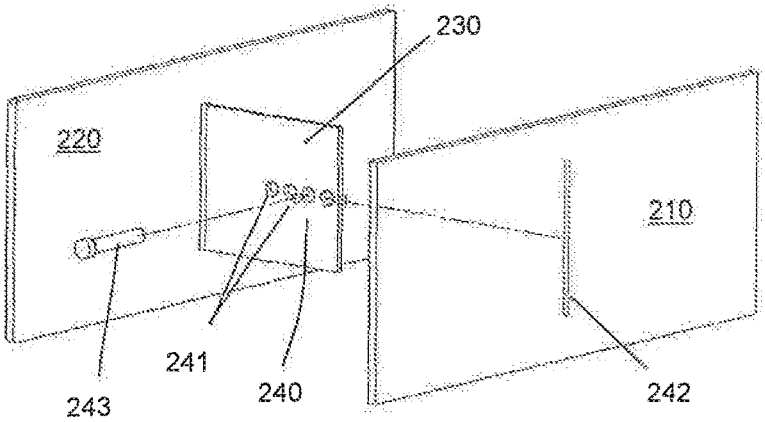
Figure 8B
Figure 8A
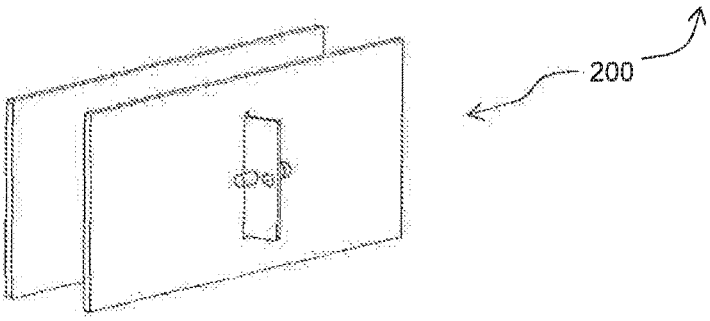

Figure 9A
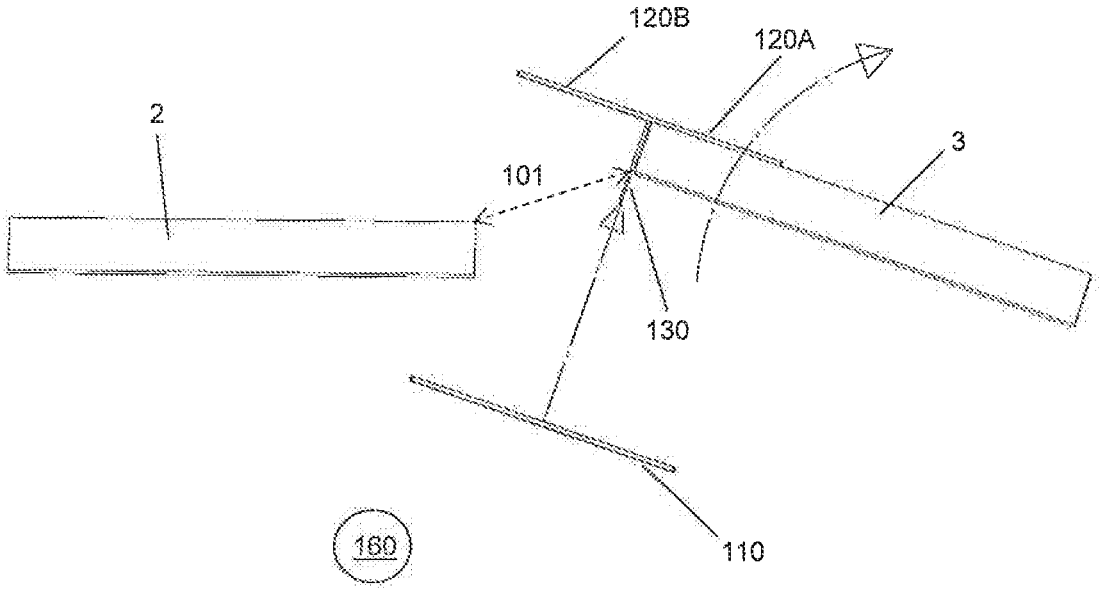
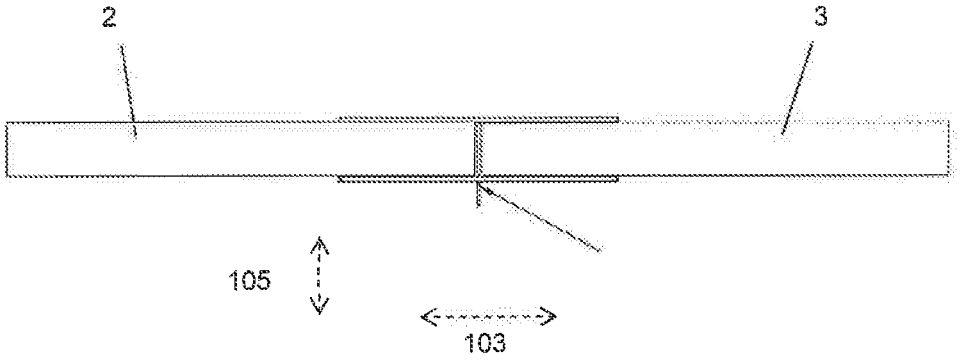
Figure 9B

FIGURE 10
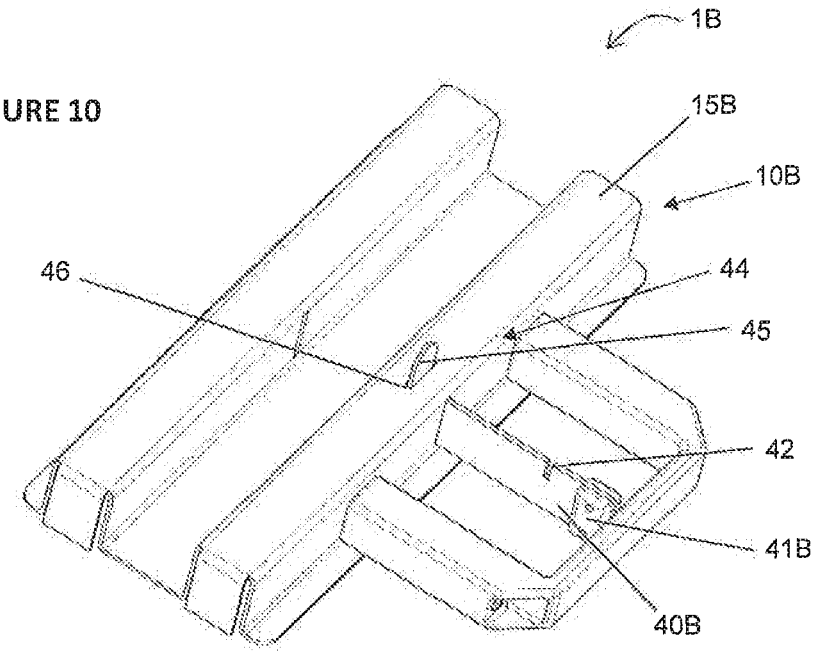
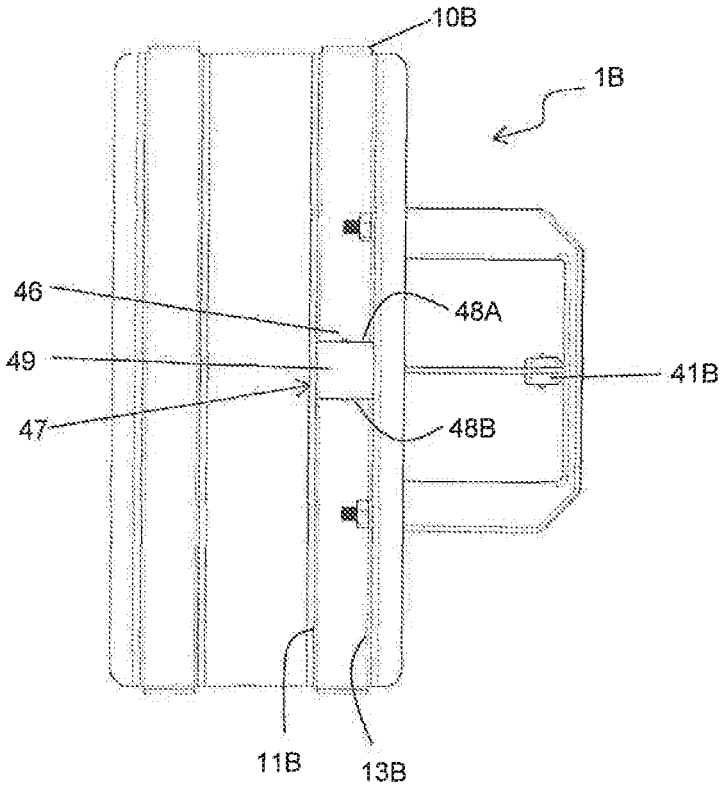
FIGURE 11

FIGURE 12
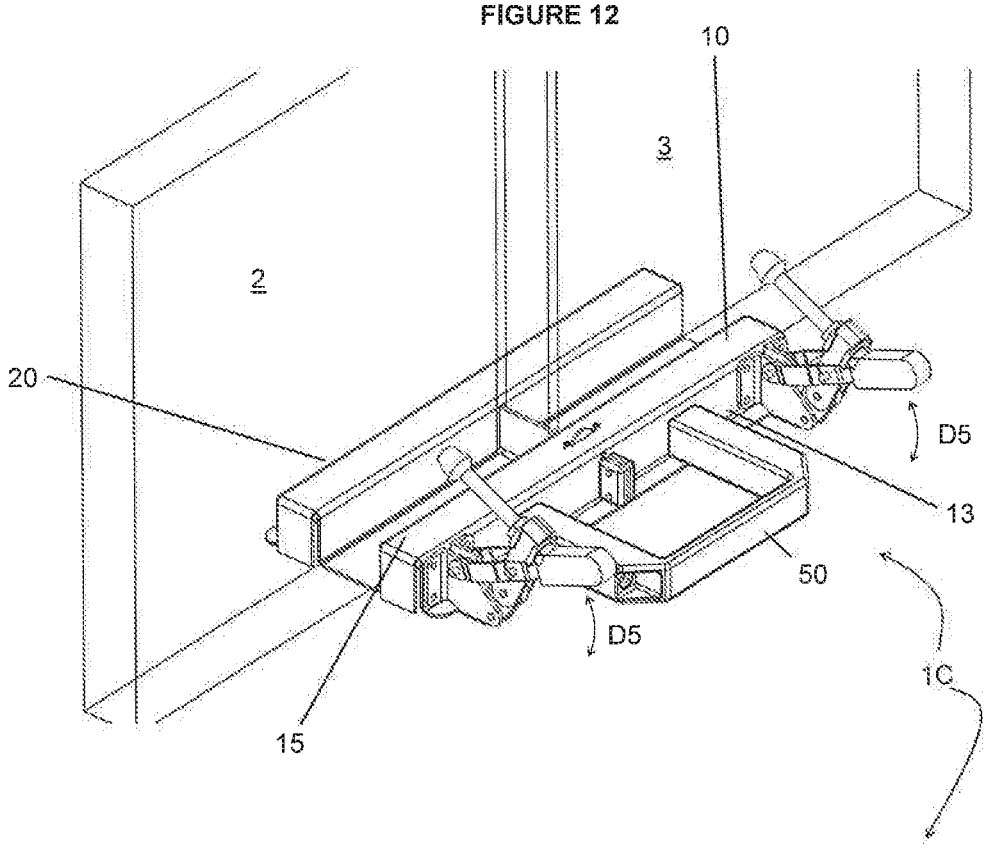
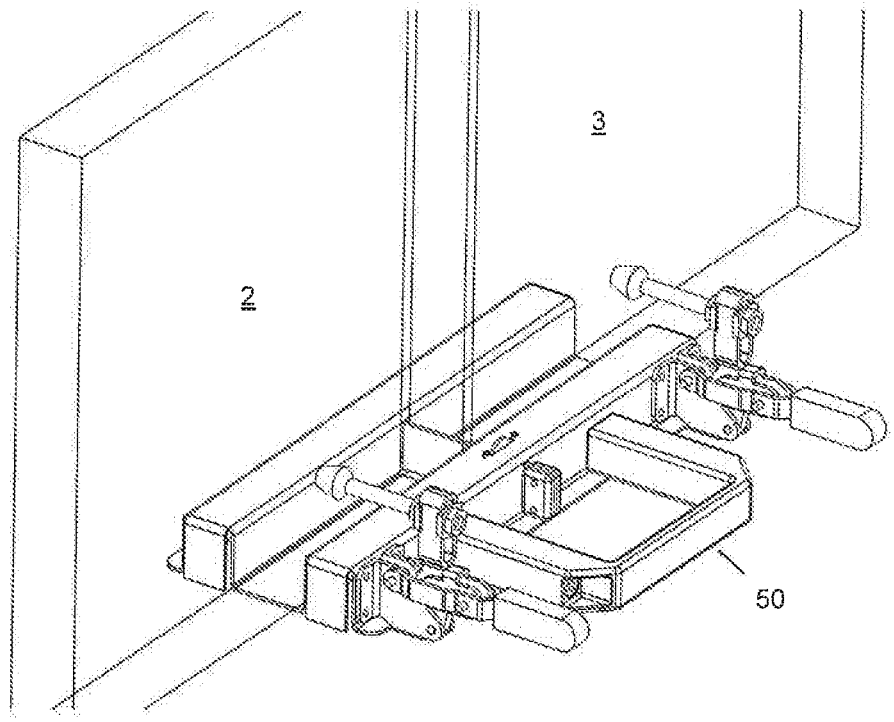
FIGURE 13

SECURITY DEVICE

CROSS-REFERENCE TO RELATED PATENT APPLICATIONS

The present application claims the benefit of and priority to United Kingdom Patent Application No. 1804738.1, filed Mar. 23, 2018. The contents of this application is incorporated herein by reference in its entirety.

TECHNICAL FIELD

The invention relates to security devices for doors and/or windows. Specifically, the invention relates to removable security devices which can prevent or restrict opening of a hinged double door or double window assembly.

BACKGROUND

The present invention is applicable to hinged double door and window assemblies. Hinged double doors and windows typically consist of a pair door or window leafs housed within a door or window frame. For ease of description, both door and window assemblies will be described throughout with reference to door assemblies only.

Each door leaf is hinged on its outer, frame side edge. The door leafs can be single hinged or double hinged. The leading edges of the door leafs are configured to meet in the middle of the doorway. Typically the leading edges of one or both of the doors are provided with a gasket or sealing strip in order to prevent draughts flowing between the door leafs.

It is often desired to provide increased security beyond only door locks. This is especially true when a property is going to be closed for an extended period of time, for example, if the occupiers are going on holiday or the property is unoccupied. In other situations, it is desirable block unnecessary doors which would go unused. It is thus desirable to provide a security device which can improve the security of a door and which is not vulnerable to an attacker breaking or picking a lock.

In more extreme situations, such as a terrorist attack or emergency lock-down of a building, it is desirable to disable doors quickly. In such situations, it is desirable to fit a physical barrier to restrict the movement of the door.

SUMMARY OF THE INVENTION

Existing security devices for doors are often designed to disable to door handle, and thus are limited by the strength of the locking mechanism installed on the door. Alternative security devices may include a brace which can be fitted to the door and optionally fitted to the floor or hooked around the door frame. Typically such devices are only effective on the internal side of inwardly opening doors. Due to the width of typical double doors, braces which engage the door frame are very large and unwieldly.

The present invention thus seeks to resolve or ameliorate one or more of the problems of existing products, or provide a useful alternative thereto.

According to a first aspect of the invention, there is provided a removable security device for a double door or window assembly comprising a pair of hinged door or window leafs. The security device may comprise a first barrier for positioning against a first side of the pair of door or window leafs. The security device may comprise a second barrier for positioning against an opposing side of the pair of door or window leafs. The security device may comprise a connecting portion for connecting the first and second barriers. The security device may be configured, when installed, to prevent movement of the door or window leafs relative to each other.

The door or window assembly may comprise a door or window frame. The pair of door or window leafs may be hinged on their outer sides, adjacent to the frame. The first barrier may be positioned against (e.g. positioned immediately adjacent to, abutting and/or contacting) both of the door or window leafs on the first side, and the second barrier may be positioned against (e.g. positioned immediately adjacent to, abutting and/or contacting) both of the door or window leafs on an opposing side.

The removable security device may be configured so that when installed, the connecting portion retains the first and second barrier against the opposing sides of the door or window leafs to thereby prevent movement of the pair of door or window leafs relative to each other.

The first and second barriers thus retain the door or window leafs in a position wherein they are aligned and/or coplanar i.e. when both doors are closed. Since the connecting portion connects the first and second barrier, should a person attempt the open one or both of the doors or window leafs, the door or window leaf would be physically blocked by the first and/or second barrier. The door or window assembly is thus inoperable until the security device is removed.

Beneficially, the security device can be installed from either side of the door or window assembly. Furthermore, the security device is configured to work with inward or outward opening doors, as well as double hinged doors wherein both doors can open in either direction.

The first and/or second barrier may be provided with a non-marking surface. The non-marking surface may comprise a covering, coating, bumper or similar device. The non-marking surface may comprise a plastics or rubber material. The non-marking surface may be configured to prevent damage to the door or window leafs when the security device is installed.

The removable security device may further comprise a handle. The handle may be provided on or connected to the first barrier.

In a first series of embodiments, the connecting portion may be configured to extend between the door frame or sill and the door leafs. In use, the connecting portion may be located above or below the door or window leafs, and sandwiched between the door or window leafs and the door frame. For example, the first barrier, second barrier and the connecting portion may define a channel for receiving a portion of each of the door or window leafs. The channel may be a U-shaped channel. The open face of the U-shaped channel may be opposed to the connecting portion.

The removable security device may further comprise a locking means configured to restrict removal of the security device and/or restrict movement of the security device relative to the door or window leafs. In some embodiments, more than one locking means may be provided.

The locking means may be configured to restrict movement of the security device laterally of the door or window leafs. By laterally, it is intended to mean in the widthwise direction of the door or window assembly, e.g. towards the hinges located on the sides of the door or window leafs. In some embodiments, the locking means is configured to restrict movement of the security device away from a central portion of the door or window assembly e.g. the location where the door or window leafs meet. Such embodiments are desirable, since the security device effectively is braced against each of the door or window leafs. It is thus not necessary to brace the security device against the floor, wall or any other fixed point relative to the door or window leafs.

In some embodiments, additional securing means may be provided, for example, to brace the security device against a floor, wall or other fixed point relative to the door or window leafs.

The locking means may comprise at least one bolt or pin.

The at least one bolt or pin may be moveable between an engaging position wherein the bolt or pin restricts removal of the security device and/or movement of the security device relative to the door or window leafs, and a non-engaging position wherein the bolt or pin does not restrict removal of the security device and/or movement of the security device relative to the door or window leafs.

The bolt or pin may be configured to extend between the first and second barriers when in the engaging position. Moving the at least one bolt or pin may comprise sliding the at least one bolt or pin from the first barrier toward the second barrier. Alternatively, the at least one bolt or pin may be hinged, and rotated between engaging and non-engaging positions.

The bolt or pin may extend between the door or window leafs when in the engaging position. The bolt or pin may be configured to prevent the security device from being moved laterally of the door or window leafs when the bolt or pin extends between the door or window leafs.

The security device may further comprise a catch. The catch may be configured to prevent movement of the locking means. For example, the catch may be configured to prevent movement of the bolt or pin when the catch is engaged. The catch may be configured to prevent movement of the bolt or pin when the bolt or pin is in the engaging position. The catch may comprise a tab. The tab may comprise a biasing mechanism, for example, a spring. The tab may be biased so as to engage the bolt or pin automatically. The catch may comprise a notch in the bolt or pin for receiving a part of the tab.

In one series of embodiments, the at least one bolt or pin may extend into at least one recess or aperture within at least one of the door or window leafs. In some embodiments, two bolts or pins may be provided. The first bolt or pin may extend into a first recess or aperture in a first door or window leaf, and a second bolt or pin may extend into a second recess or aperture in a second door or window leaf. This series of embodiments may be in addition to, or alternative to, a bolt or pin extendable between the door or window leafs.

In some embodiments, the handle is configured to prevent removal of the bolt or pin. For example, the handle may be configured to block full retraction of the bolt or pin.

The removable security device may be configured so that the first barrier comprises a housing aperture extending through the first barrier. The housing aperture may be configured to receive the at least one bolt or pin and allow the bolt or pin to slide therein.

The removable security device may be configured so that the second barrier comprises a receiving aperture or recess. The receiving aperture or recess may extend partially through the second barrier. The receiving aperture or recess may be configured to receive an end of the bolt or pin when in the engaging position. The receiving aperture may be configured so that the at least one bolt or pin cannot be viewed and/or accessed from the second barrier side of the security device e.g. when installed.

The removable security device may further comprise at least one spacer or insert. The spacer or insert may be configured to be fitted to the first and/or second barrier. The spacer or insert may be configured to be located between the first and second barrier. The spacer or insert may be removable. The spacer or insert may be configured to fill a portion of the space between/separating the first and second barriers. In some embodiments, the security device is provided with a range of spacers or inserts of different thicknesses e.g. so that the effective distance between/separating the first and second barrier is easily configurable. Optionally, the at least one spacer may be wedge shaped. Thus it is possible to quickly adapt the security device to a range of different door thicknesses, without large empty spaces between the door leafs and the first and/or second barrier. Thus a close fit of the security device is achievable. This is desirable, since large gaps between a door leaf and the security device may permit a small amount of movement of the door leaf and can be vulnerable to further attack or provide a point wherein a crow bar or other tool could be inserted to apply a force to the door leafs.

In some embodiments, the spacer or insert may be connectable to, and moveable relative to the first and/or second barrier. The separation between the spacer or insert and the first and/or second barrier may be adjustable. Optionally, the spacer or insert may be connectable to the first and/or second barrier by at least one threaded member. The spacer or insert may be moveable by rotating the at least one threaded member. The at least one threaded member may be an elongate shaft comprising a screw-threaded surface configured to engage a further screw-threaded surface.

In some embodiments, the removable security device may comprise at least one clamp configured to clamp a door or window leaf. The at least one clamp may be configured to clamp a door or window leaf positioned between the first and second barriers, and/or the at least one clamp may be configured to clamp a door or window leaf against the first and/or second barrier.

The at least one clamp may comprise a clamping mechanism configured to move one or both of the first and second barrier portions toward and away from each other. Alternatively, the at least one clamp may comprise a moveable clamping surface provided on the first and/or second barrier, and configured to move toward the other of the first and/or second barrier.

The at least one clamp may be configured to apply a clamping force to the surface of a door or window leaf. The clamping force may be perpendicular to the plane of the door or window leaf. The at least one clamp may be configured to resist or restrict movement of the security device relative to a door or window leaf.

The at least one clamp may comprise at least one moveable clamping surface provided on a spacer or insert as described previously, and connectable to the first and/or second barrier by at least one screw-threaded member. The at least one screw-threaded member may engage with a further screw-threaded surface provided on the first and/or second barrier. Thus, by rotating the at least one threaded member, the clamping surface can be moved toward or away from a door or window leaf positioned between the first and second barriers.

The at least one clamp may comprise a toggle-clamp. The toggle clamp may comprise a moveable clamping surface which is driven by a clamping mechanism. The clamping mechanism may be actuated by a lever handle. The toggle clamp may comprise an over-centre locking mechanism. The toggle clamp may be configured so that by depressing a lever handle, the moveable clamping surface is driven to apply a clamping force to the surface of a door or window leaf. The toggle clamp may provide a very quick way by which to apply a clamping force against the surface of a door or window leaf.

Additionally or alternatively, the at least one clamp may comprise a trigger clamp and/or ratchet mechanism.

In one series of embodiments, the connecting portion is configured to extend between the door leafs. The connecting portion may extend perpendicularly from the second barrier. The second barrier and connecting portion may have a T-shape. The connecting portion and/or the first barrier may be configured so that the distance between/separating the first and second barriers is adjustable. The first barrier may be coupleable to the connecting portion. The first barrier may be removable. The first barrier may be moveable relative to the second barrier, but not removable from the connecting portion. The first barrier may be slideable along the connecting portion. The first barrier may comprise an opening through which the connecting portion can extend. The first barrier may be slideable along the connecting portion.

The removable security device may further comprise a locking means configured to restrict removal of the security device and/or restrict movement of the security device relative to the door or window leafs. In some embodiments, more than one locking means may be provided. The locking means may be configured to prevent the first barrier moving relative to the second barrier and/or the connecting portion.

The locking means may comprise at least one bolt or pin. The locking means may further comprise at least one recess or aperture for receiving the at least one bolt or pin. The at least one recess or aperture may be located on the connecting portion. The connecting portion may comprise multiple recesses or apertures for receiving the at least one bolt or pin. The multiple recesses or aperture may relate to the first barrier being locked at varying distances from the second barrier. In some embodiments the bolt or pin may comprise the shackle of a padlock.

In use, the second barrier may be positioned adjacent the door or window leafs, on the opposing side to the user, with the connecting portion extending between the door or window leafs. The first barrier can then be moved along connecting portion until positioned against the door or window leafs and locked in position by the locking means. In embodiments wherein the first barrier is not removable from the connecting portion, it may be necessary to rotate the security device around the axis of the connecting portion to position the first and second barrier against opposing sides of the door or window leafs.

In a further aspect of the invention, there is provided a removable security device for a double door or window assembly comprising a pair of hinged door or window leafs, the security device comprising: a first barrier and a second barrier connectable by a connecting portion, and configured so that in use, the connecting portion holds the first and second barrier on opposing sides of the door or window leafs to thereby prevent movement of the pair of door or window leafs relative to each other. The removable security device may be combinable with any feature described previously.

BRIEF DESCRIPTION OF THE DRAWINGS

The invention will now be described with reference to the following figures, wherein:

FIGS. 6A-6D are plan views from above showing a method of installing a security device;

FIGS. 7A and 7B are perspective views of a security device in disassembled and assembled states respectively;

FIGS. 8A and 8B are perspective views of a security device in disassembled and assembled states respectively;

FIGS. 9A and 9B are plan views from above showing a method of installing a security device;

FIG. 10 is a perspective view of a security device; and

FIG. 11 is an underneath view of a security device.

FIG. 12 is a perspective view of a security device in a first position; and

FIG. 13 is a perspective view of the security device of FIG. 12 in a second position.

SPECIFIC DESCRIPTION OF THE FIGURES

Figure 1:
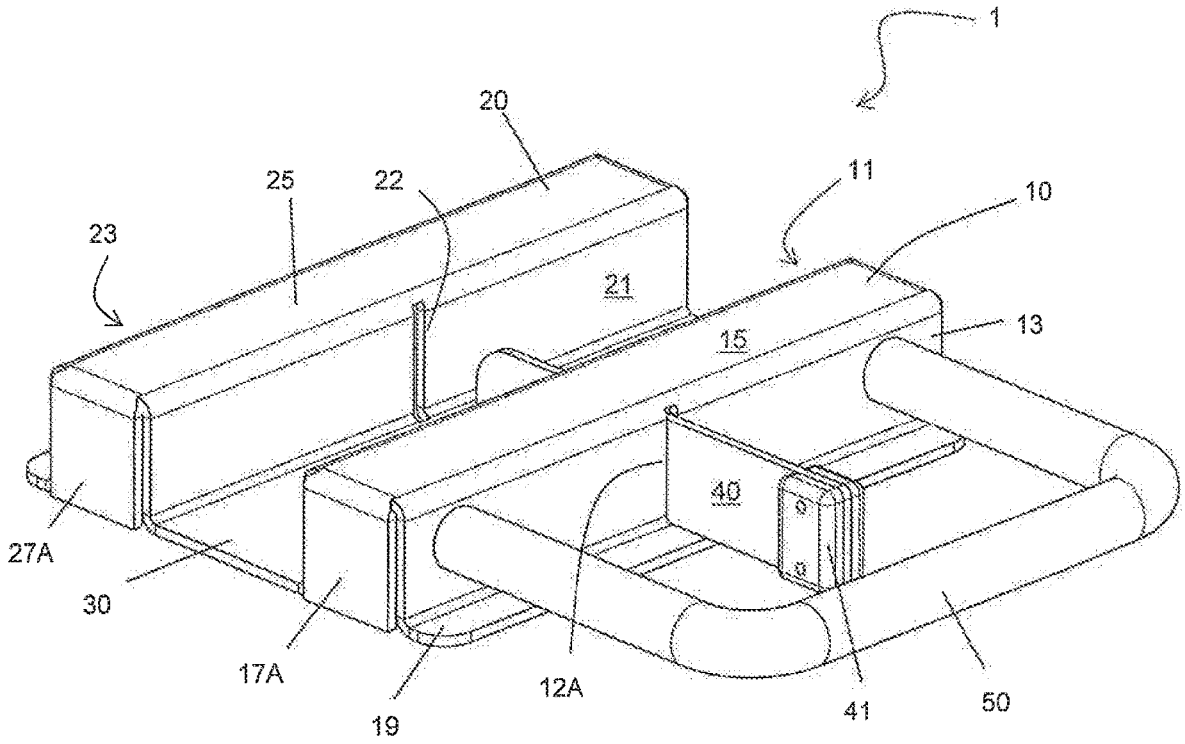
FIG. 1 is a perspective view of a security device.
Figure 2:
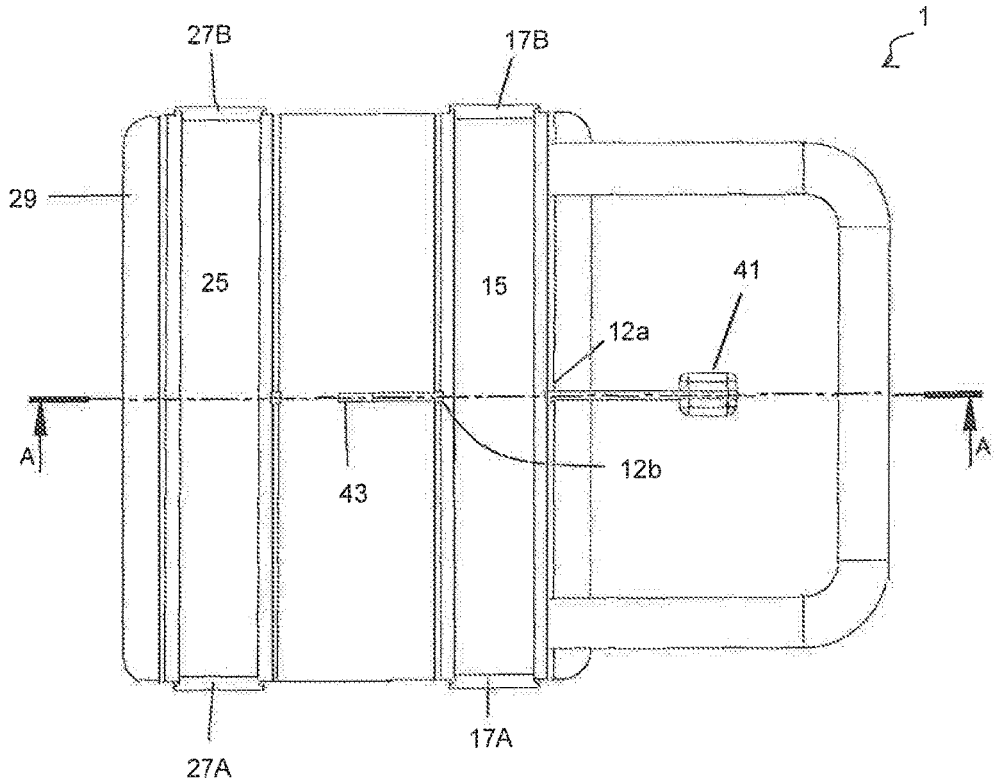
FIG. 2 is a plan view from above of a security device.
Figure 3:
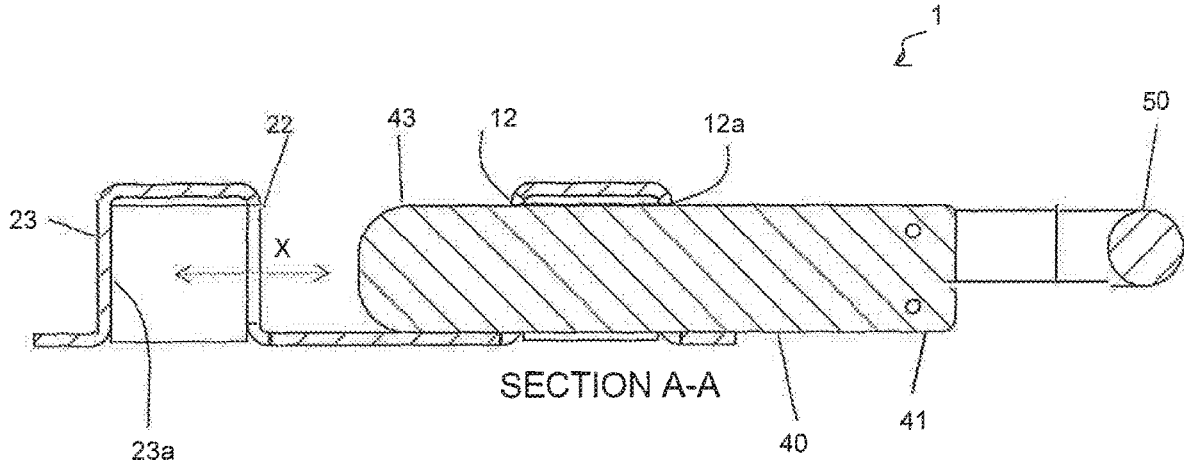
FIG. 3 is a cross section through the security device of FIG. 2 in the plane A-A.

Turning now to FIGS. 1 to 3, there is shown a security device 1. The security device 1 has a first barrier 10 and a second barrier 20 joined by a connecting portion 30.

The first barrier 10 is has a cuboidal shape, comprising a first barrier face 11 and first opposing face 13 joined by a first bridging face 15, and closed by a pair of end faces 17A, 17B. The lower face (not shown) of the cuboidal first barrier 10 is open, and the first barrier is substantially hollow. The first opposing face 13 is provided with a first lower lip 19. The first barrier face 11 and the first opposing face 13 are provided with first slots 12*a*, 12*b*, which together define a housing aperture extending through the first barrier 10.

The second barrier 20 is has a cuboidal shape, comprising a second barrier face 21 and second opposing face 23 joined by a second bridging face 25, and closed by a pair of end faces 27A, 27B. The lower face (not shown) of the cuboidal second barrier 10 is open, and the second barrier is substantially hollow. The second opposing face 23 is provided with a second lower lip 29. The second barrier face 21 is provided with a receiving slot 22, which defines a receiving recess or aperture.

The connecting portion 30 is a flat plate extending between lower edges of the first barrier face 11 and the second barrier face 21. The connecting portion 30 is coplanar with the first and second lower lips 19, 29, which thus form a flat base for the security device 1 which can easily be positioned on the floor.

The first barrier 10 is further provided with a handle 50. The handle 50 is broadly C-shaped, and extends from the first opposing face 13. The handle 50 can be affixed by bolts or rivets (not shown) extending through the first opposing face 13, or alternatively the handle 50 can be welded or adhered directly to the surface. The handle 50 indicates the user side (or "internal" side) of the security device 1, with the second barrier 10 comprising the opposing side (or "external" side) of the security device 1. It is to be appreciated that the device can be fitted to a door assembly from either side, and thus the terms internal and external are for guidance only.

The security device 1 comprises a locking means comprising a bolt 40, housed within the housing aperture in the first barrier 10. The bolt 40 has a handle portion 41 making it easier for a user to grip. The axial movement of the bolt 40 is limited at a first end by the handle 50, and he opposing end by the inner surface 23*a* of the second opposing face 23. The bolt 40 is otherwise freely slideable relative to the first barrier 10, through the first slots 12*a*, 12*b* and relative to the second barrier 20 through the receiving slot 22, in the direction X shown in FIG. 3.

The bolt 40 is thus moveable between an engaging position and a non-engaging position. In the engaging position, the bolt 40 extends between the first and second barriers 10, 20. Preferably, the leading end 43 of the bolt 40 is received within the substantially hollow second barrier 20. In some alternative embodiments, the second barrier 20 may be solid rather than hollow, in which case the receiving slot 22 may extend into the thickness of the barrier 20 e.g. from the second barrier face 21 toward the second opposing ace 23. In the non-engaging position, the bolt 40 is retracted toward the handle 50, and thus the leading end 43 of the bolt 40 does not extend, or only minimally extends, between the first and second barriers 10, 20.

Figure 4:
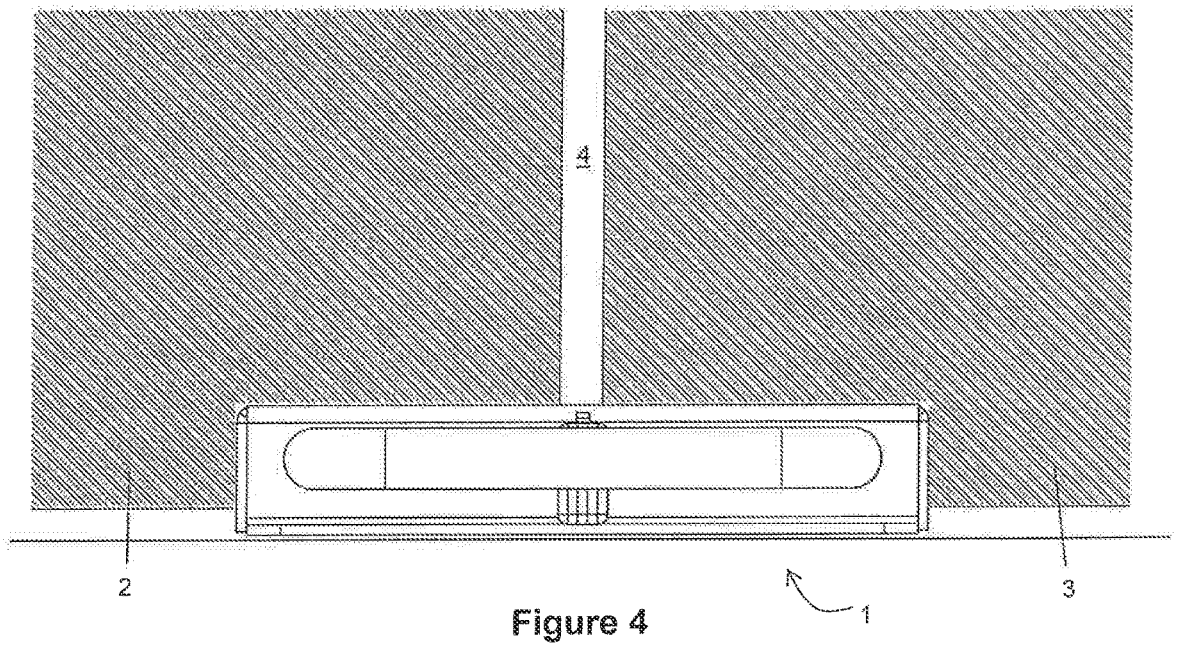
FIG. 4 is an end of view of a security device in use.
Figure 5:
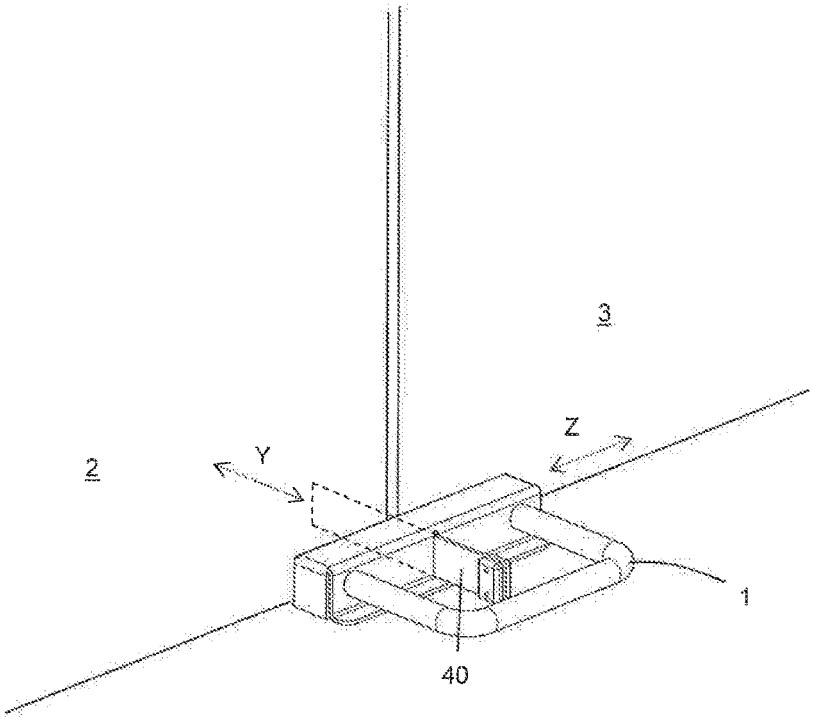
FIG. 5 is a perspective view of a security device in us.

Turning now to FIGS. 4 and 5, the security device 1 is shown installed on a set of double doors comprising a pair of doors 2, 3. The security device 1 is positioned in the central region 4 of the double doors where the doors 2, 3 meet. Not shown in FIGS. 4 and 5 is the second barrier 20 which is positioned against the opposing faces of the doors 2, 3.

The central region 4 is a small gap between the doors 2, 3 and is commonly fitted with a weather seal or flexible gasket to prevent draughts through the doorway. Since the doors 2, 3 do not completely meet, the central region 4 provides sufficient space for the bolt 40 to pass through the central region and thus extend between the doors 2, 3. Preferably the bolt 40 has a width of no greater than 3 mm, to allow insertion between a pair of doors, where the conventional separation is approximately 3 mm. In some cases it may be necessary to trim the bottom of the leading edge of one or both of the doors 2, 3 (or provide a recess therein) adjacent to the bolt 40 to provide sufficient room for the bolt 40 to move between the doors 2, 3. In such embodiments it may be possible to utilise a bolt with a thickness greater than 3 mm for increased strength.

The lower edge of the doors 2, 3 is received between the first and second barriers 10, 20 above the connecting portion 30. It is thus necessary for the connecting portion 30 to be longer (in the direction of the arrows x or y) than the depth of the doors 2, 3. Preferably the connecting portion 30 is only slightly longer than the depth of the doors 2, 3 in order to ensure a relatively close fit for the security device. Alternatively, a spacer (not shown) can be provided to reduce the distance between the first barrier face 11 and the second barrier face 21.

In FIG. 5 the bolt 40 is partially retracted, and can be slid in the direction of the arrow Y as indicated by the dashed lines, until the leading end 43 is received within the receiving slot in the second barrier (not shown). The bolt 40 is thus in the engaging position. In the engaging position, the bolt 40 prevents the security device 1 from being moved laterally of the doors 2, 3 (i.e. in either direction indicated by arrow Z), since it will contact the end faces of the doors 2, 3. Since the leading end 43 of the bolt 40 is received within the second barrier 20, it is not accessible by any person on the opposing side of the doors 2, 3. Thus a person facing the side of the doors 2, 3 with the second barrier 20 is unable to push the bolt 40 toward the handle 50 and into the non-engaging position.

The installation of the security device 1 will now be described with reference to FIGS. 6 A to D. FIG. 6A shows a pair of doors 2, 3, which are hinged on their outer sides by hinges 4. As a first step, one of the doors, in the example case door 3, is slightly opened by a user 60. The door 3 may be opened further if desired, but all that is required is for the door 3 to be opened sufficiently wide for the second barrier face 20 to pass through the gap between open doors 2, 3. The security device 1 is then moved in the direction D1, for example by sliding the security device 1 along the floor underneath the lower edge of the door 3. As shown in FIG. 6B, the doors 2, 3 can then be closed by moving the open door in the direction D2. It should be appreciated that it does not matter whether the doors 2, 3 are inward or outward opening, or whether they are double hinged. All that is required is that the doors 2, 3 are partially opened.

As shown in FIG. 6C the security device is then slid in the direction D3 until it spans the two doors 2, 3 as shown in FIG. 6D. As this point the locking means e.g. bolt 40 can be moved in the direction D4 to the engaging position between the doors 2, 3. A user 70 on the opposing side of the doors 2, 3 is thus unable to open either door since it is blocked by the security device 1.

Turning now to FIGS. 10 and 11, there is shown a security device 1B. The security device 1B is substantially identical to the security device 1 as described above and as shown in FIGS. 1 to 6, and descriptions of like features held will not be repeated.

The first barrier 10B is substantially the same as first barrier 10, except that the first bridging face 15B is provided with a bolt catch 44. The bolt catch 44 is configured to prevent movement of the locking bolt 40B once the locking bolt 40B has been moved into the engaging position.

The bolt catch 44 comprises a tab 45, which is received within a catch slot 46 in the first bridging face 15B. The tab 45 and catch slot 46 extend along the first barrier 10B parallel with the length of the barrier 10B. The locking bolt 40B is substantially the same as locking bolt 40 described above, except the locking bolt 40B is provided with a notch 42 in its uppermost edge, that is, the edge closest to the first bridging face 15B. The tab 45 is moveable relative to the first bridging face 15B in an upwards direction (as pictured) and/or toward and away from the locking bolt 40B. In use, a user can grip the upper end of the tab 45, and lift the tab 45 upwardly and/or away from the locking bolt 40B.

In FIG. 11, the security device 1B is shown from below. The first barrier 10B is open faced on the surface which would be immediately adjacent the floor in use, thus viewed from underneath the first barrier 10B is approximately U-shaped. The first barrier 10B is provided with a reinforcing portion 47 which extends between and connects to the edges of the first barrier face 11B and the first opposing face 13B located opposite to the first bridging face 15B. Thus, the first barrier face 11B, the first bridging face 15B, the first opposing face 13B and the reinforcing portion define a closed loop with a rectangular or square cross section. The reinforcing portion 47 is preferably welded to the first barrier face 11B and the first opposing face 13B, and provides a strong support preventing the compression of the first barrier 10B.

The reinforcing portion 47 is formed of a plate portion 49, which lies in the plane of the open end face of the first barrier 10B, and a pair of side walls 48A, 48B. The side walls 48A-B extend upwardly from the plate portion 49 toward the first bridging face 15B, thus forming a U-shaped cross-section when viewed in the plane of the bolt 40B. In some embodiments, the edges of the side walls 48A-B can be connected to the first barrier face 11B and the first opposing face 13B, and/or the tops of the side walls 48A-B can be connected to the first bridging face 15B. In other embodiments, the side walls 48A-B extend toward the first bridging face 15B, the first barrier face 10B and the first opposing face 13B, but the side walls 48A-B are not connected thereto. This configuration sacrifices strength for ease of manufacture and alignment. Each of the side walls 48A-B is provided with a slot (not shown) which extends upwardly and is aligned with the catch slot 46 in the first bridging face 15B. Thus, when the tab 45 drops or is biased into the notch 42, it is also received within the slots in the side walls 48A-B. Thus, if the bolt catch 44 is engaged, the bolt 40B is prevented from being retracted by the tab 45 engaging both the catch slot 46 and the slots in the side walls 48A_B. The slots in the side walls 48A_B thus prevent the tab 45 from twisting and thus the bolt catch 44 is more secure.

With the bolt catch 44 disengaged, the locking bolt 40B is able to move freely relative to the first barrier 10B. When the locking bolt 40B is moved into the engaging position, as described above, the notch 42 will be located immediately below the tab 45. The tab then moves into the notch 42 so that it's lowermost (not shown) end is received within the notch 42. The movement of the tab 45 can either be under the influence of gravity, and thus the tab 45 simply drops into position, or the tab 45 can be biased toward the locking bolt 40B, for example by a spring (not shown). Any suitable spring or biasing mechanism can be used, for example: a leaf spring or a compression spring connected between the tab 25 and the first barrier 10B. Thus the bolt catch 44 is immediately engaged whenever the locking bolt 40B is pushed sufficiently inwardly (i.e. toward the second barrier 20B). This can provide a clear indication to a user when the security device 1B is secured, since the tab 45 engaging the notch 42 will provide a click which the user can see, hear and feel.

The bolt catch 44 thus reduced, inhibits or prevents axial movement of the locking bolt 40B. This increases the reliability of the security device 1B, since a person on the opposite side of the door cannot lift the tab 45 and thus cannot push the locking bolt 40B back into the disengaged position. When a user is ready to uninstall the security device 1B, the tab 45 is first lifted to disengage the bolt catch 44 and the locking bolt 40B retracted into the disengaged position by the user pulling the handle portion 41B. The security device 1B can then be moved laterally relative to the door assembly and the doors opened without encumbrance as described previously.

Turning back to FIGS. 7 to 9, there are shown two alternative embodiments of the security device and the method of installation.

In FIGS. 7A and 7B, there is shown a security device 100 in a partially dis-assembled and assembled state respectively. The security device 100 has a first barrier 110, a second barrier 120, and a connecting portion 130. The connecting portion 130 projects perpendicularly from the surface of the second barrier portion 120, toward the first barrier 110. The connecting portion 130 is provided with a locking means 140 consisting of a series of slots 141 on the upper edge of the connecting portion 130, and a cooperating slots 142 in the lower edge of the first barrier 110. The connecting portion 130 is a thin plate, and is configured to extended between the door leafs of a pair of double doors in use.

The width of the slots 141 and the cooperating slot 142 are configured to permit interlocking of the first barrier 110 and the connecting portion 130, as shown in FIG. 7B. When the slots 141 and cooperating slot 142 are engaged with each other, movement of the first barrier relative to the second is restricted. The series of slots 141 permit a degree of adjustability, and thus the offset between the first and second barriers 110, 120 can be adjusted. Thus, the security device 100 can be fitted to doors with various thicknesses of door leaf without requiring modification of the security device 100.

FIGS. 8A and 8B show a further security device 200 which is largely similar to the security device 100. The security device 200 has a first barrier 210, a second barrier 220 and a connecting portion 230. The security device 200 is provided with a locking means 240 consisting of a rail and pin mechanism. The connecting portion 230 is provided with a series of locking holes 241 distributed along the length of the connecting portion 240. The first barrier 210 comprises a slot 242 configured so that the connecting portion 230 can be inserted therethrough. A locking pin 243 is provided and is configured to be insertable into the locking holes 241. To assemble the security device 200, the first barrier 210 is positioned over the connecting portion 230 so that the connecting portion 230 extends through the slot 242, and the locking pin 243 is inserted into the appropriate locking hole 241. The connecting portion 230 and slot 242 thus prevent the first barrier from moving laterally or vertically (as pictured) and the pin 243 thus restricts the first barrier from moving away from the second barrier 220.

Turning now to FIG. 9, the installation of the security devices 100, 200 will be described. As in FIGS. 6A-D, there is shown a double door assembly comprising a pair of doors 2, 3. The doors are hinged on their outer edges, and just the central region where the leading edges abut is shown. The doors 2, 3 are provided with a security device 100, although the method of installation is the same with respect to the security device 200.

In the first step, one of the doors 2, 3 is partially opened to provide a gap 101 by a user 160. The gap 101 in FIG. 9A is exaggerated for clarity, since the leading edge of the door 3 would normally be closer to the door 2. The second barrier 120 is inserted through the gap 101 and positioned on the face of the door opposite to the user 160. The door 3 is positioned so that the leading edge is contacted by the corner formed between the second barrier 120 and the connecting portion 130. A first half 120B of the second barrier 120 thus extends along the surface of the door on one side of the connecting portion 130, and the second half 120B extends away from the door 3 on the opposite side of the connecting portion 130. The user 160 then holds the connecting portion 130 to maintain the security device 100 in position adjacent to the door 3 while the door 3 is closed. When the door is closed, the second half 120B of the second barrier is positioned against the door 2, and the connecting portion 130 extends between the two doors 2, 3.

As shown in FIG. 9B, the user 160 then positions the first barrier 110 over the connecting portion 130 so that the cooperating slot 142 engages one of the slots 141. Preferably, the user selects the available slot 141 closest to the doors 2, 3 to ensure a close fit of the security device 100. When the slot 141 and cooperating slot 142 are engaged with each other, the first and second barriers 110, 120 are coupled together, and cannot be moved relative to each other in either the widthwise direction of the doors 2, 3 nor can they be moved toward or away from each other (i.e. in the direction 105). Should a user on the opposite side of the doors to the user 160 attempt to open either door 2, 3 the movement of the doors 2, 3 will be impeded by the barriers 110, 120 and thus the door is locked closed. To open the doors, it is necessary to first remove the first barrier 110 from the security device 100 by reversing the above steps.

As shown in FIG. 9A, the doors 2, 3 are hinged so that they open outwardly (i.e. away from the user 160). For inwardly opening doors (not shown), the installation process is modified. Firstly, one of the doors is opened to produce a gap, and the second barrier 120 is then positioned against the stationary door. The partly open door is then closed and the first barrier 110 connected to the connecting portion 130.

With respect to the security device 200, the above installation process is identical, except the final step of engaging the slots is replaced with the step of fitting the first barrier 210 over the connecting portion 230 until the first barrier 210 contacts the doors 2, 3 and then inserting the locking pin 243 through one of the exposed locking holes 241.

What is claimed is:

1. A removable security device for a double door or window assembly comprising a pair of hinged door or window leafs, the security device comprising:

a first barrier for positioning against a first side of the pair of door or window leafs;

a second barrier for positioning against an opposing side of the pair of door or window leafs;

a connecting portion for connecting the first and second barriers; and a locking bolt or pin configured to restrict removal of the security device and/or restrict movement of the security device relative to the door or window leafs;

wherein the locking bolt or pin is freely slideable, relative to the first and second barriers, in a central region between the door or window leafs along an axis extending from the first barrier to the second barrier; and wherein the security device is configured, when installed, to prevent movement of the door or window leafs relative to each other.

2. The removable security device according to claim 1, configured so that when installed, the connecting portion retains the first and second barrier against the opposing sides of the door or window leafs to thereby prevent movement of the pair of door or window leafs relative to each other.

3. The removable security device according to claim 1, further comprising a handle.

4. The removable security device according to claim 1, wherein the connecting portion is configured to extend between the door frame or sill and the door leafs.

5. The removable security device according to claim 1, wherein the first barrier, second barrier and the connecting portion define a channel for receiving a portion of each of the door or window leafs.

6. The removable security device according to claim 1, wherein the locking bolt or pin is moveable between an engaging position wherein the locking bolt or pin restricts removal of the security device and/or movement of the security device relative to the door or window leafs, and a non-engaging position wherein the locking bolt or pin does not restrict removal of the security device and/or movement of the security device relative to the door or window leafs.

7. The removable security device according to claim 6, wherein the locking bolt or pin is configured to extend between the first and second barriers when in the engaging position.

8. The removable security device according to claim 6, wherein the locking bolt or pin extends between the door or window leafs when in the engaging position.

9. The removable security device according to claim 8, wherein the locking bolt or pin is configured to prevent the security device from being moved laterally of the door or window leafs when the locking bolt or pin extends between the door or window leafs.

10. The removable security device according to claim 3, wherein the handle is configured to prevent removal of the locking bolt or pin.

11. The removable security device according to claim 1, wherein the first barrier comprises a housing aperture extending through the first barrier configured to receive the locking bolt or pin and allow the locking bolt or pin to slide therein.

12. The removable security device according to claim 6, wherein the second barrier comprises a receiving aperture or recess extending partially through the second barrier and configured to receive an end of the locking bolt or pin when in the engaging position.

13. The removable security device according to claim 1, further comprising a spacer or insert.

14. The removable security device according to claim 1, further comprising at least one clamp configured to clamp the door or window leafs.

15. The removable security device according to claim 14, wherein the at least one clamp comprises a toggle clamp.

16. The removable security device according to claim 1, wherein the locking bolt or pin is configured to extend perpendicularly to at least one of the first barrier and the second barrier.

17. The removable security device according to claim 1, wherein the first barrier comprises a first barrier face and a first opposing face, connected by a first bridging face.

18. The removable security device according to claim 17, wherein the locking bolt or pin is configured to extend perpendicularly to at least one of the first barrier face and the first opposing face.

19. The removable security device according to claim 1, wherein the second barrier comprises a second barrier face and a second opposing face, connected by a second bridging face.

20. The removable security device according to claim 19, wherein the locking bolt or pin is configured to extend perpendicularly to at least one of the second barrier face and the second opposing face.

21. The removable security device according to claim 3, wherein the handle is provided on or connected to the first barrier.

22. The removable security device according to claim 11, wherein the housing aperture extends perpendicularly through the first barrier.

23. The removable security device according to claim 12, wherein to the receiving aperture or recess extends partially through the second barrier from the second barrier face toward the second opposing face.

24. The removable security device according to claim 6, comprising:

a bolt catch; and a notch in the locking bolt or pin;

wherein the notch in the locking bolt or pin is configured to receive the bolt catch when the locking bolt or pin is in the engaging position to prevent the movement of the locking bolt or pin.

25. The removable security device according to claim 24, wherein the bolt catch comprises:

a tab; and a catch slot;

wherein the catch slot is located in the first barrier of the removable security device and wherein the catch slot is configured to receive the tab.

26. The removable security device according to claim 25, wherein the catch slot is located in the first bridging face of the first barrier.

27. The removable security device according to claim 25, wherein a lowermost end of the tab is configured to be received within the notch in the locking bolt or pin.

28. The removable security device according to claim 25, wherein the bolt catch comprises a spring configured to bias the tab to automatically engage the notch in the locking bolt or pin.

29. The removable security device according to claim 13, wherein the spacer or insert is removable.

* * * * *